US007836863B2

(12) United States Patent
Kwak et al.

(10) Patent No.: US 7,836,863 B2
(45) Date of Patent: Nov. 23, 2010

(54) VARIABLE VALVE LIFT APPARATUS OF ENGINE FOR VEHICLES

(75) Inventors: Young Hong Kwak, Seoul (KR); Kiyoung Kwon, Seoul (KR); Jin Kook Kong, Seoul (KR); Kyoung Joon Chang, Seoul (KR)

(73) Assignee: Hyundai Motor Company, Seoul (KR)

( * ) Notice: Subject to any disclaimer, the term of this patent is extended or adjusted under 35 U.S.C. 154(b) by 126 days.

(21) Appl. No.: 12/267,361

(22) Filed: Nov. 7, 2008

(65) Prior Publication Data

US 2009/0151694 A1 Jun. 18, 2009

(30) Foreign Application Priority Data

Dec. 14, 2007 (KR) ..... 10-2007-0131588

(51) Int. Cl.
*F02D 13/02* (2006.01)
*F02D 13/00* (2006.01)

(52) U.S. Cl. ..... 123/346; 123/345

(58) Field of Classification Search ..... 123/346, 123/345, 90.15, 90.16, 90.17, 90.48
See application file for complete search history.

(56) References Cited

U.S. PATENT DOCUMENTS

| | | | | |
|---|---|---|---|---|
| 4,469,056 | A * | 9/1984 | Tourtelot et al. | 123/90.16 |
| 2001/0037781 | A1* | 11/2001 | Fischer et al. | 123/90.24 |
| 2005/0241598 | A1* | 11/2005 | Ezaki | 123/90.16 |
| 2007/0062472 | A1* | 3/2007 | Asada et al. | 123/90.16 |
| 2008/0302320 | A1* | 12/2008 | Tateno et al. | 123/90.16 |

* cited by examiner

*Primary Examiner*—Mahmoud Gimie
(74) *Attorney, Agent, or Firm*—Morgan, Lewis & Bockius LLP

(57) ABSTRACT

A variable lift apparatus of an engine for a vehicle may include a camshaft in which a cam is formed, a swing arm one side of which is supported by a supporting portion and another side of which operates a valve, an output arm including a roller press portion extended in one direction and a rotating arm extended in another direction, a first roller disposed in the connecting portion in which the rotating arm and the roller press portion are connected and that contacts the cam, a second roller disposed in the swing arm and contacting a roller contacting surface, a variable link connected with a lower end side of the rotating arm protruding in a lower side of the output arm by a hinge shaft and moves the hinge shaft according to a guide slot formed in a guide and a variable rotation shaft for operating the variable link.

20 Claims, 5 Drawing Sheets

VARIABLE VALVE LIFT APPARATUS OF ENGINE FOR VEHICLES

CROSS-REFERENCE TO RELATED APPLICATION

The present application claims priority to Korean Patent Application No. 10-2007-0131588, filed on Dec. 14, 2007, the entire contents of which is incorporated herein for all purposes by this reference.

BACKGROUND OF THE INVENTION

1. Field of the Invention

The present invention relates to a variable valve lift apparatus of an engine for a vehicle, and more particularly to a variable valve lift apparatus of an engine for a vehicle that can continuously vary a valve lift height.

2. Description of Related Art

Generally, a combustion chamber, in which fuel burns, is formed in an engine so that a vehicle can generate power. A valve train including an intake/exhaust valve that can control intake air and exhaust gas is disposed adjacent to the combustion chamber. The valve train opens and closes the combustion chamber by a crankshaft.

Generally, in such a valve train, a cam that has a regular shape lifts a valve as much as a predetermined lift amount, but the amount of the intake air or exhaust gas cannot be variably controlled.

Accordingly, when the valve train is designed according to a low speed driving condition, the timing and period that the valve is opened is not enough to satisfy a high speed driving condition, and when the valve train is designed corresponding to a high speed driving condition, the opposite phenomenon occurs.

More specifically, when the general engine is tuned for a high speed, the valve lift is established larger, and thereby the engine has excellent performance at high speed but has problems satisfying idle stability and torque at low speed.

On the contrary, when the general engine is tuned for a low speed, the engine has excellent performance at low speed but has problems satisfying output at high speed. However, in a variable valve lift apparatus, the valve lift can be variably controlled corresponding to a high or low speed, and so more advantages at low and high speed can be obtained.

Recently, techniques for improving charging efficiency as well as multi-valves for improving fuel consumption and output power have been developed. As a result, a variable induction system (VIS) in which a length or cross-section of the intake manifold can be variably controlled in accordance with a rotation range of the engine so as to minimize the resistance of the intake air, a variable valve timing (VVT) apparatus for controlling opening timing and opening amount of the valve so as to vary the overlap timing, and a variable valve lift (VVL) apparatus have been developed.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention have been made in an effort to provide a variable lift apparatus of an engine having advantages of continuously changing a size of the valve lift and controlling an opening timing of the valve.

A variable lift apparatus of an engine for a vehicle may include a camshaft in which a cam is coaxially formed thereon; a swing arm one side of which is pivotally supported by a supporting portion and another side of which operates a valve; an output arm wherein a portion of the output cam is positioned above the swing arm; a first roller disposed in the output arm and opposite the supporting portion of the swing arm, and contacting the cam; a second roller that is disposed in the swing arm and contacts the portion of the output arm; a variable link pivotally connected with a portion of the output arm by a hinge shaft and moving the hinge shaft along a guide slot; and a rotation shaft eccentrically connecting the variable link and an actuating shaft and, moving the variable link.

The output arm may comprise: a roller press portion that is extended in one direction and comprises a roller contacting surface; and a rotating arm that is extended in another direction from an end portion of the roller press portion.

The roller press portion may be formed substantially in a horizontal direction and pushes the second roller of the swing arm in a lower direction; and the rotating arm connects the two roller press portions formed on two intake valves and is extended in a lower direction in a predetermined length.

The first roller may be disposed in a connecting portion connecting the rotating arm and the roller press portion thereon. The roller press portion and the rotating arm may form an integral single body. The first roller may be disposed in a connecting portion connecting the rotating arm and the roller press portion. The second roller may contact the roller contacting surface of the output arm, wherein the roller contacting surface has at least a predetermined curvature.

The rotation of the actuating shaft may be controlled by an actuator. 9. The first roller may be supported by an elastic member and thereby the first roller is contacted with the cam. The guide slot may be arc-shaped. The guide slot may be aligned substantially in horizontal direction. The guide slot may be formed at a guide. The supporting portion of the swing arm may be a valve gap adjust portion.

Another aspect of the present invention is directed to a variable lift apparatus of an engine for a vehicle may comprise: a camshaft in which a cam is coaxially formed thereon; a swing arm one side of which is pivotally supported by a supporting portion and another side of which operates a valve; an output arm that includes a roller press portion that is extended in one direction and a rotating arm that is extended in another direction from one end portion of the roller press portion; a first roller that is disposed in a connecting portion in which the rotating arm and the roller press portion are connected thereon and that contacts the cam, wherein the connecting portion is disposed opposite the supporting portion of the swing arm; a second roller that is disposed in the swing arm and contacts a roller contacting surface formed a lower portion of the roller press portion; a variable link pivotally connected by a hinge shaft with a lower end portion of the rotating arm that protrudes in a lower direction and moves the hinge shaft along a guide slot that is formed in a guide; and a rotation shaft eccentrically connecting the variable link and an actuating shaft, and moving the variable link.

The roller press portion may be formed in a horizontal direction and pushes the second roller of the swing arm in a lower direction; and the rotating arm that connects the two roller press portions in the middle of two intake valves and is extended in a lower direction in a predetermined length, wherein the first roller is disposed in an upper end portion of the rotating arm. The roller contacting surface may have at least a predetermined curvature. The rotation of the actuating shaft may be controlled by an actuator. The first roller may be supported by an elastic member and thereby the first roller is contacted with the cam.

According to the present invention the lift height of the intake valve can be continuously and accurately controlled. Also, opening timing and opening amount of the valve can be effectively controlled. The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
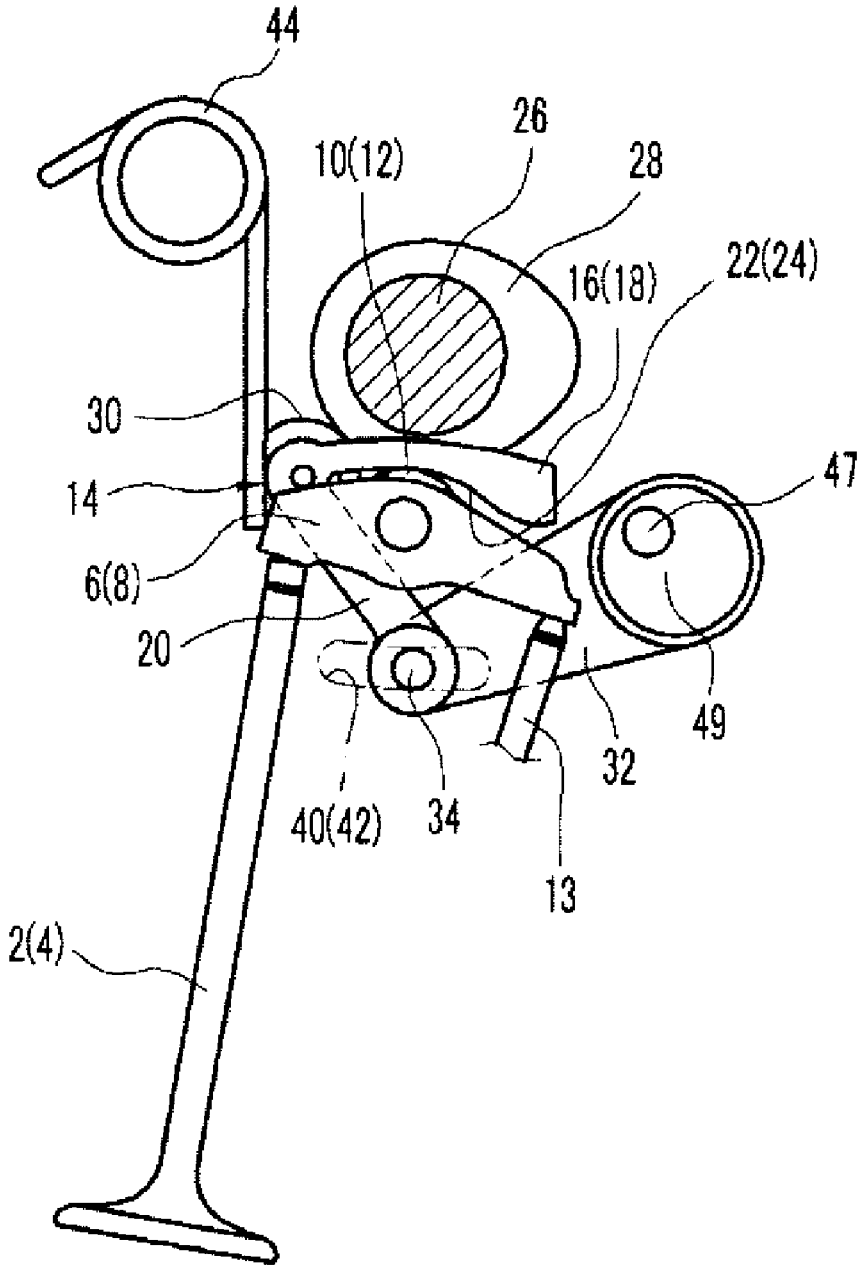
FIG. 1 is a side view of an exemplary variable lift apparatus in accordance with the present invention.
Figure 2:
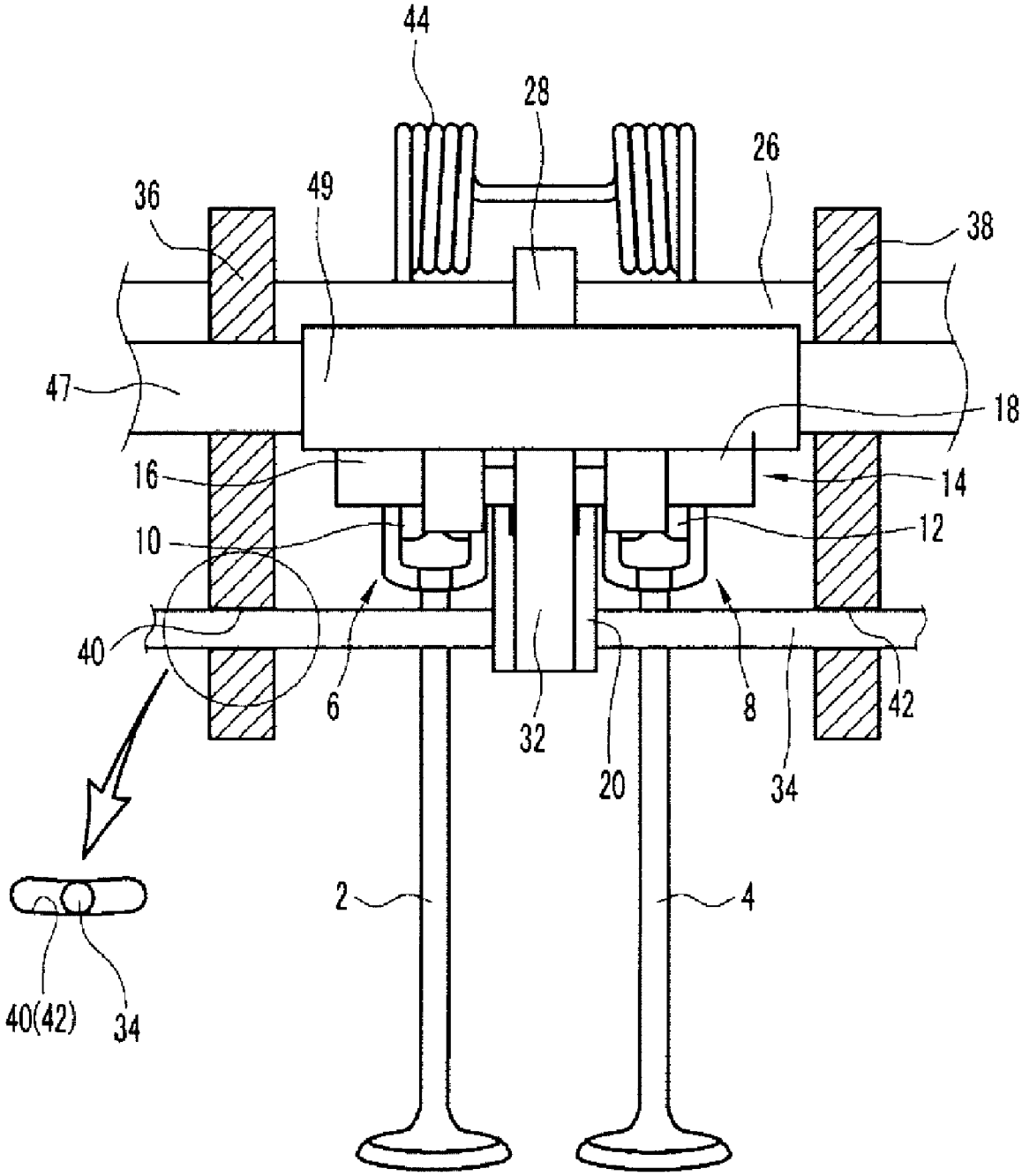
FIG. 2 is a front view of FIG. 1.
Figure 3:
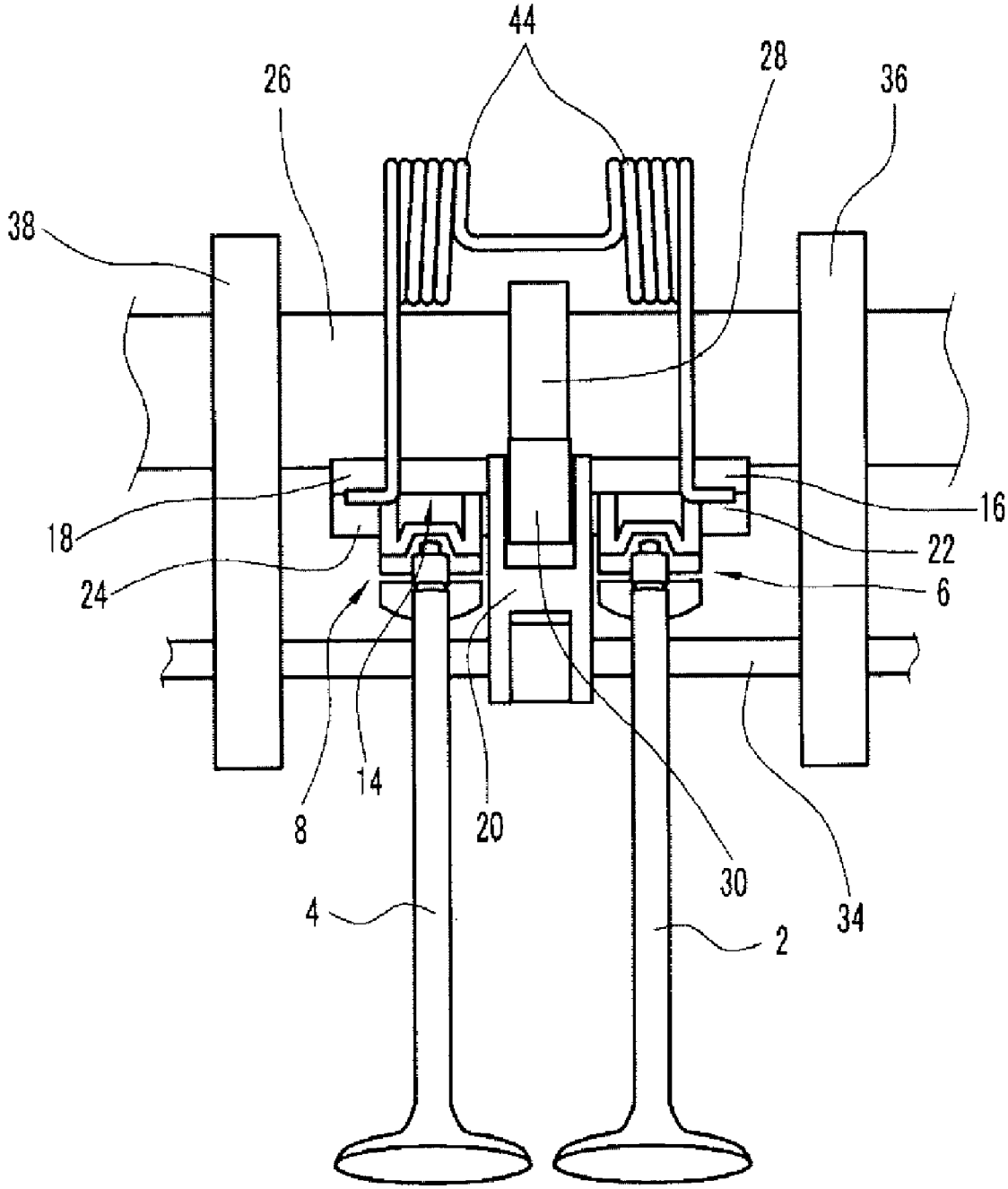
FIG. 3 is a rear view of FIG. 1.

FIG. 1 is a side view of a variable lift apparatus according to an exemplary embodiment of the present invention, FIG. 2 is a front view of FIG. 1, and FIG. 3 is a rear view of FIG. 1.

A variable lift apparatus may be applied to an engine having two intake valves per cylinder according to an exemplary embodiment of the present invention. One will appreciate that the variable lift apparatus may also be applied to an engine having more than two intake valves per cylinder in various embodiments of the present invention.

As shown in FIG. 1, the variable lift apparatus may include a camshaft 26, a cam 28, a first roller 30, an output arm 14 comprising a rotating arm 20 and roller press portions 16 and 18, second rollers 10 and 12, swing arms 6 and 8, a valve gap adjust portion 13, and intake valves 2 and 4.

Also, the variable lift apparatus may include a variable link 32 that is rotatably coupled to one portion of the rotating arm 20 by a hinge shaft 34, a rotation shaft 49 that is rotatably connected to the variable link 32, and an actuating shaft 47 that is disposed eccentric from the center of the rotation shaft 49. Particularly, the hinge shaft 34 connecting the rotating arm 20 and the variable link 32 moves in accordance with guide slots 40 and 42 having a predetermined shape.

That is, the second rollers 10 and 12 are disposed in the middle at an upper side of the swing arms 6 and 8. The two intake valves 2 and 4 are disposed at one end portion of the swing arms 6 and 8 and a valve gap adjust portion 13 is disposed at the other end portion of the swing arms 6 and 8 with respect to the second rollers 10 and 12.

The output arm 14 for operating the second rollers 10 and 12 may be disposed adjacent to the second rollers 10 and 12 of the swing arms 6 and 8.

In detail, the output arm 14 includes the roller press portions 16 and 18 horizontally formed on the second roller 10 and 12 that pivotally press downwards the second rollers 10 and 12 of the swing arms 6 and 8.

Also, referring to FIG. 2, the output arm 14 may include the rotating arm 20 that is extended in a lower direction from the roller press portion 16 and 18 as much as in a predetermined length, and the rotating arm 20 is rotatably connected to the variable link 32 by the hinge shaft 34.

A bottom surface of both roller press portions 16 and 18 may contact the second rollers 10 and 12 of the swing arms 4 and 6, and roller contacting surfaces 22 and 24 having a regular curvature are formed therein.

Referring to FIG. 2, a cam 28 of camshaft 26 is disposed between both roller press portions 16 and 18, and the first roller 30 is operated by the cam 28. The first roller 30 is disposed between the roller press portions 16 and 18, or the intake valves 2 and 4 as shown in FIG. 2.

Further, a lower end portion of the rotating arm 20 is connected to the variable link 32 by the hinge shaft 34 as set forth above.

The hinge shaft 34 for connecting the variable link 32 with the rotating arm 20 is slidably coupled to arc-shaped guide slots 40 and 42 that are formed in guides 36 and 38 that are disposed in both sides.

Accordingly, the hinge shaft 34 may move back and forth within the guide slots 40 and 42, and the rotating arm 20 that is connected thereto can rotate back and forth thereby with respect to the hinge shaft 34.

An elastic member 44 that is formed as a coil spring always make an restoring force to contact the first roller 30 with the cam 28.

Such as stated above, when the rotating arm 20 moves back and forth along the guide slots 40 and 42, the roller press portions 16 and 18 that are integrally formed therein also rotate back and forth with respect to the hinge shaft 34.

Further, as set forth above, the variable link 32 that is connected to the rotating arm 20 is rotatably coupled to the rotation shaft 49 and is generally inclined in an upper direction, and the rotation shaft 49 rotates by the actuating shaft 47.

The actuating shaft 47 may rotate by a non-illustrated actuator, the rotation shaft 49 that is integrally and formed thereto rotates eccentrically by the actuating shaft 47, and thereby the variable link 32 moves back and forth or in a right and left direction.

That is, the rotation shaft 49 moves the hinge shaft 34 along the guide slots 40 and 42 that are formed in the guides 36 and 38.

Accordingly, as the rotating arm 20 rotates with respect to the hinge shaft 34, the portion, in which the roller press portions 16 and 18 and the second rollers 10 and 12 of the swing arms 6 and 8 contact, may vary to change the lift amount of the intake valves 2 and 4 as explained in detail hereinafter.

In a variable lift apparatus according to an exemplary embodiment of the present invention, the cam 28 moves the first roller 30 downwards when the camshaft 26 rotates in the normal condition.

Then, the first roller 30 is pushed to the left side, and thereby the output arm 14, which includes the rotating arm 20 and the roller press portions 16 and 18, rotates on the base of the hinge shaft 34 in the counterclockwise as shown in FIG. 1.

In this way, as the roller press portions 16 and 18 move, the second rollers 10 and 12 of the swing arms 6 and 8 are pushed in a lower direction according to the shape of the roller press portions 16 and 18.

Figure 4:
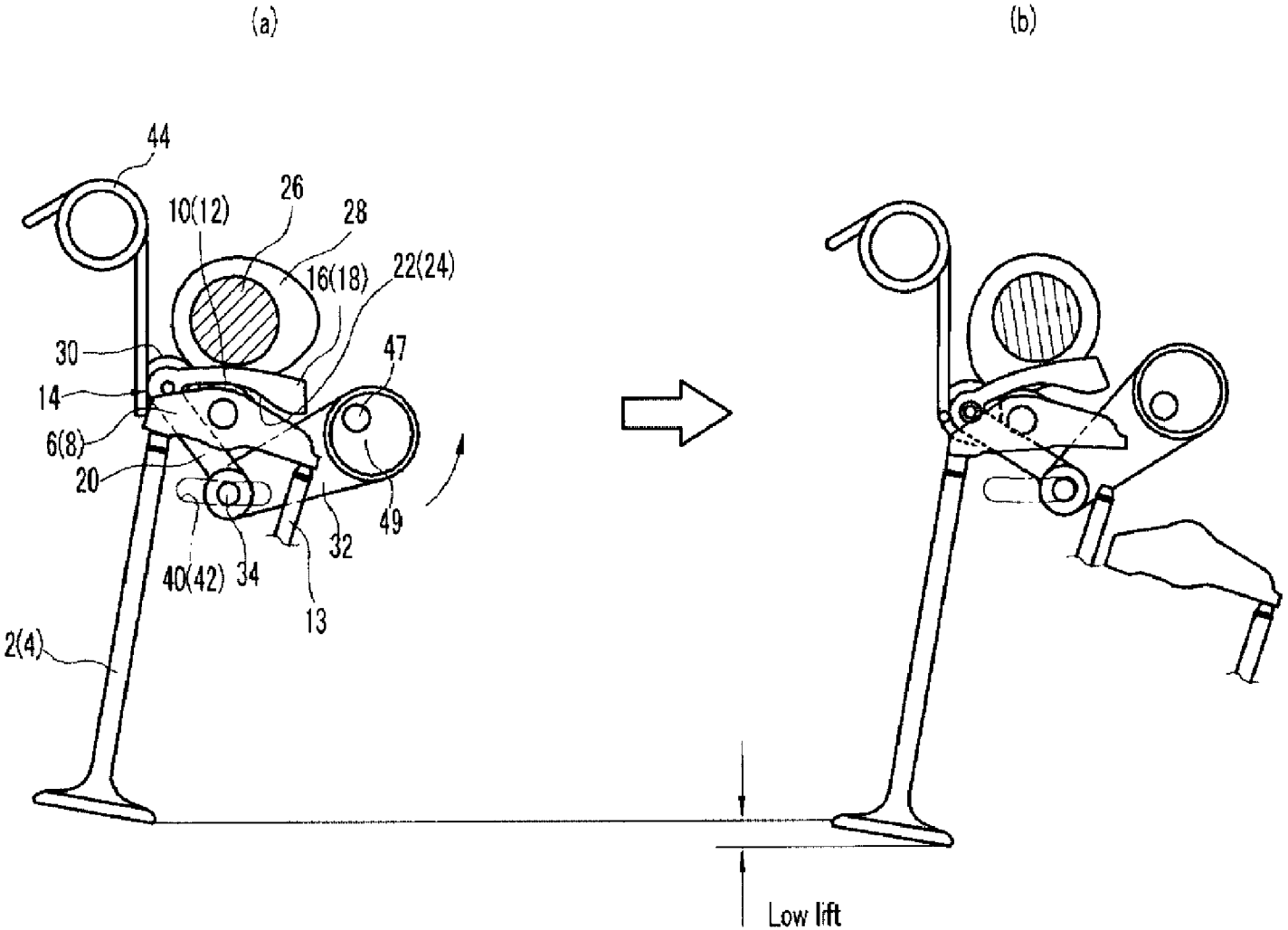
FIG. 4 is a side view showing a low lift condition of an exemplary variable lift apparatus in accordance with the present invention.

Referring to FIG. 4(*a*), the variable rotation shaft 47 is rotated counterclockwise by an actuator (not shown) so as to reduce the lift amount of the valve according to the driving condition of the engine. One will appreciate that various actuators may be utilized in an otherwise conventional manner to rotate the variable rotation shaft in accordance with the present invention.

Then, the variable link 32 is drawn in a right and upper direction.

Accordingly, the rotating arm 20, which is connected to the variable link 32, moves within the guide slots 40 and 42, wherein the hinge shaft 34 moves in a right direction.

Then, the roller press portions 16 and 18 of the output arm 14 rotates counterclockwise on the basis of the hinge shaft 34 around the second rollers 10 and 12 of the swing arms 6 and 8.

As stated above, the variable valve lift apparatus has a state such as shown by the solid line in FIG. 4(*b*).

In this state, the cam 28 rotates the first roller 30 counterclockwise such that the output arm 14 rotates counterclockwise centering around the hinge shaft 34, and thereby the roller press portions 16 and 18 press the second rollers 10 and 12 in a lower portion.

In this way, referring to FIG. 4(*b*), as the roller press portions 16 and 18 of the output arm 14 rotates counterclockwise and thus the contact portion formed between the lower portion of the roller press portions 16 and 18 and the second rollers 10 and 12 moves in the left direction, the timing to move the second rollers 10 and 12 is delayed such that the valve lift height is minimized.

Figure 5:
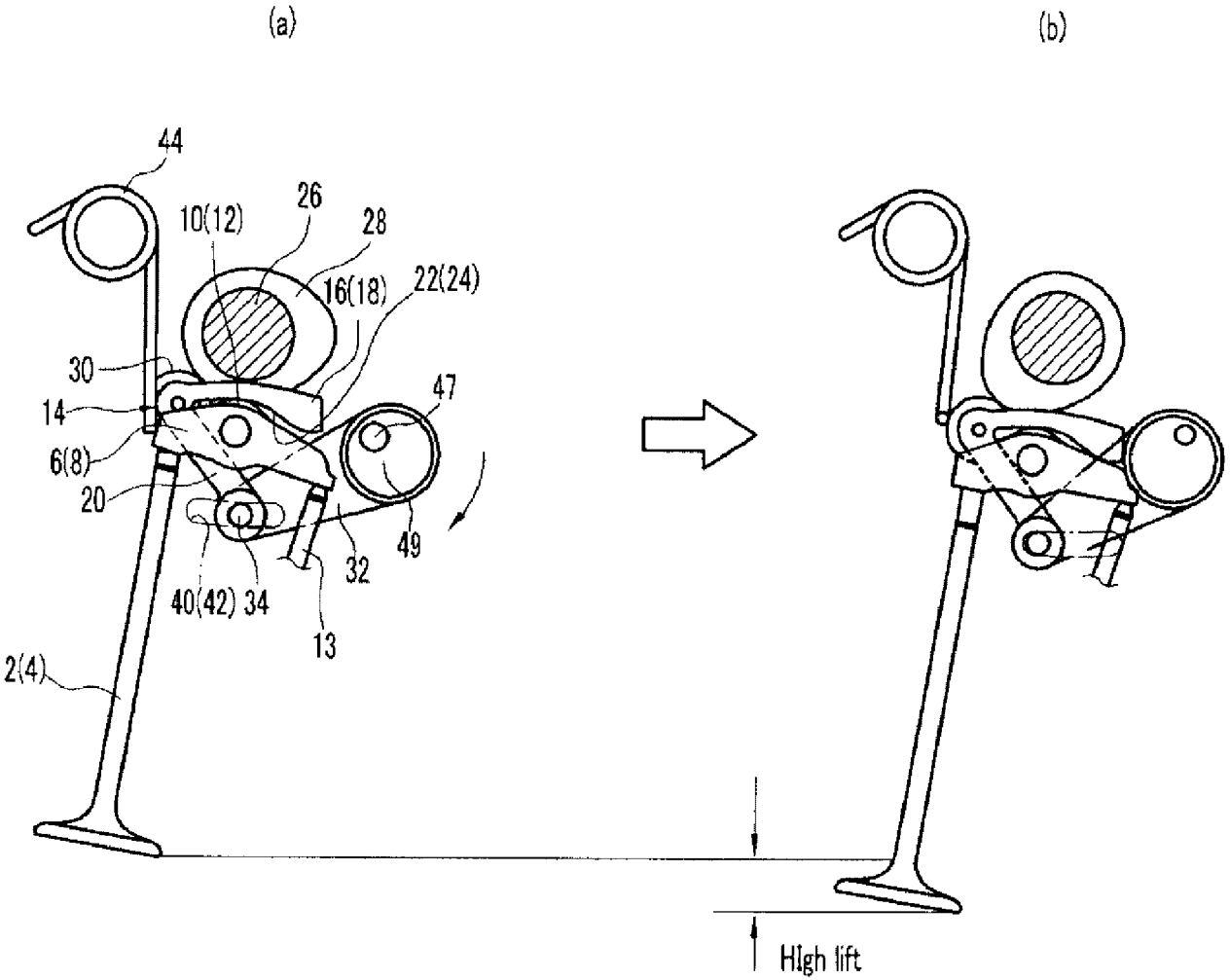
FIG. 5 is a side view showing a high lift condition of an exemplary variable valve lift apparatus in accordance with the present invention.

Conversely, referring to FIG. 5(*a*), the actuating shaft 47 rotates clockwise so as to increase the valve lift height.

Then, the rotation shaft 49, which is integrally formed with the actuating shaft 47, rotates together such that the variable link 32 that is connected thereto is pushed in a lower direction.

Accordingly, the rotating arm 20 that is connected to the variable link 32 moves within the guide slots 40 and 42, wherein the hinge shaft 34 moves in a left direction.

At this time, the roller pressure portions 16 and 18 rotate clockwise by the operation of the rotating arm 20 around the second rollers 10 and 12 of the swing arms 6 and 8 with respect to the hinge shaft 34.

In this way, referring to FIG. 5(*b*), as the roller press portions 16 and 18 of the output arm 14 rotates clockwise and thus the contact portion formed between the lower portion of the roller press portions 16 and 18 and the second rollers 10 and 12 moves in the right direction and thereby the roller press portions 16 and 18 press the second rollers 10 and 12 in a high height, the timing to move the second rollers 10 and 12 is fast.

Accordingly, as the cam 28 rotates, the first roller 30 is pushed and the output arm 14 rotates in a counterclockwise direction on the basis of the hinge shaft 34 and presses the second rollers 10 and 12. Then, the roller press portions 16 and 18 move in a counterclockwise direction such that the second rollers 10 and 12 are pressed by the roller press portions 16 and 18 earlier than a normal time.

When the second rollers 10 and 12 are pressed according to the shape of the roller contacting surfaces 22 and 24 of the roller press portions 16 and 18, the lift height of the valve is maximized, as shown in FIG. 5(*b*).

In the variable lift apparatus that is operated as above, an electrical control unit (ECU) controls the operating portion in accordance with the driving condition of the engine, and thereby the lift height of the intake valves 2 and 4 can be continuously and accurately controlled. For convenience in explanation and accurate definition in the appended claims, the terms "up" or "upper", "down" or "lower", "front" or "rear", "inside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable lift apparatus of an engine for a vehicle, comprising:

a camshaft in which a cam is coaxially formed thereon;

a swing arm, one side of which is pivotally supported by a supporting portion and another side of which operates a valve;

an output arm wherein a upper portion of the output arm is positioned above the swing arm;

a first roller rotatably connected to the output arm and opposite the supporting portion of the swing arm, and contacting the cam;

a second roller that is disposed on the swing arm wherein the upper portion of the output arm is selectively slidable on the second roller in a forward or rearward direction of the second roller;

a variable link pivotally connected with a lower portion of the output arm by a hinge shaft and moving the hinge shaft along a guide slot wherein the upper portion of the output arm is pivotally rotatable about the hinge shaft; and a rotation shaft eccentrically connecting the variable link and an actuating shaft and, moving the variable link.

2. The variable lift apparatus of claim 1, wherein the output arm comprises:

a roller press portion that is extended in one direction and comprises a roller contacting surface; and a rotating arm that is extended in another direction from an end portion of the roller press portion.

3. The variable lift apparatus of claim 2, wherein the roller press portion is formed substantially in a horizontal direction and pushes the second roller of the swing arm in a lower direction; and the rotating arm connects the two roller press portions formed on two intake valves and is extended in a lower direction in a predetermined length.

4. The variable lift apparatus of claim 2, wherein the first roller is disposed in a connecting portion connecting the rotating arm and the roller press portion thereon.

5. The variable lift apparatus of claim 2, wherein the roller press portion and the rotating arm form an integral single body.

6. The variable lift apparatus of claim 5, wherein the first roller is disposed in a connecting portion connecting the rotating arm and the roller press portion.

7. The variable lift apparatus of claim 2, wherein the second roller contacts the roller contacting surface of the output arm, wherein the roller contacting surface has at least a predetermined curvature.

8. The variable lift apparatus of claim 1, wherein rotation of the actuating shaft is controlled by an actuator.

9. The variable lift apparatus of claim 1, wherein the first roller is supported by an elastic member and thereby the first roller is contacted with the cam.

10. The variable lift apparatus of claim 1, wherein the guide slot is arc-shaped.

11. The variable lift apparatus of claim 1, wherein the guide slot is aligned substantially in horizontal direction.

12. The variable lift apparatus of claim 1, wherein the guide slot is formed at a guide.

13. The variable lift apparatus of claim 1, wherein the supporting portion of the swing arm is a valve gap adjust portion.

14. An engine comprising:

intake valves; and the variable lift apparatus of claim 1.

15. A variable lift apparatus of an engine for a vehicle, comprising:

a camshaft in which a cam is coaxially formed thereon;

a swing arm one side of which is pivotally supported by a supporting portion and another side of which operates a valve;

an output arm that includes a roller press portion that is extended in one direction and a rotating arm that is extended in another direction from one end portion of the roller press portion;

a first roller that is rotatably connected to a connecting portion in which the rotating arm and the roller press portion are connected thereon and that contacts the cam, wherein the connecting portion is disposed opposite the supporting portion of the swing arm;

a second roller that is disposed in the swing arm wherein a roller contacting surface formed in a lower portion of the roller press portion is selectively slidable on the second roller in a forward or rearward direction of the second roller;

a variable link pivotally connected by a hinge shaft with a lower end portion of the rotating arm that protrudes in a lower direction and moves the hinge shaft along a guide slot that is formed in a guide wherein the roller press portion of the output arm is pivotally rotatable about the hinge shaft; and a rotation shaft eccentrically connecting the variable link and an actuating shaft, and moving the variable link.

16. The variable lift apparatus of claim 15, wherein the roller press portion is formed in a horizontal direction and pushes the second roller of the swing arm in a lower direction; and the rotating arm that connects the two roller press portions in the middle of two intake valves and is extended in a lower direction in a predetermined length, wherein the first roller is disposed in an upper end portion of the rotating arm.

17. The variable lift apparatus of claim 15, wherein the roller contacting surface has at least a predetermined curvature.

18. The variable lift apparatus of claim 15, wherein rotation of the actuating shaft is controlled by an actuator.

19. The variable lift apparatus of claim 15, wherein the first roller is supported by an elastic member and thereby the first roller is contacted with the cam.

20. An engine comprising:

intake valves; and the variable lift apparatus of claim 15.

* * * * *